United States Patent [19]

Northup

[11] 4,128,184

[45] Dec. 5, 1978

[54] CHILD-PROOF CONTAINER AND CAP

[76] Inventor: John D. Northup, 2460 Underhill Rd., Toledo, Ohio 43615

[21] Appl. No.: 905,750

[22] Filed: May 15, 1978

[51] Int. Cl.[2] ..... B65D 55/02; B65D 85/56; A61J 1/00

[52] U.S. Cl. ..... 215/222; 215/350; 215/DIG. 1

[58] Field of Search ..... 215/222, 343, 350, 351, 215/211, DIG. 1

[56] References Cited

U.S. PATENT DOCUMENTS

| | | | |
|---|---|---|---|
| 3,331,523 | 7/1967 | Exton | 215/350 |
| 3,756,445 | 9/1973 | Hedgewick | 215/222 |
| 3,917,096 | 11/1975 | Hedgewick | 215/211 |
| 4,059,198 | 11/1977 | Mumford | 215/222 |

*Primary Examiner*—George T. Hall
*Attorney, Agent, or Firm*—Allen Owen

[57] ABSTRACT

A child-proof container and cap combination is disclosed which seals the contents of the container against moisture vapor deterioration by making a seal which is "tight" by industry standards. The cap requires less than seven inch pounds of torque for removal. The seal is obtained by the cooperation of a flexible sealing lip on a separate element supported or disposed on the interior surface of the cap and cooperating with a rigid tapered sealing surface on the container.

2 Claims, 4 Drawing Figures

CHILD-PROOF CONTAINER AND CAP

BACKGROUND OF THE INVENTION

In my copending application, Ser. No. 713,679 (now U.S. Pat. No. 4,091,948), there is disclosed a container and closure combination capable of sealing the container contents from the atmosphere with a "tight" seal. A "tight" seal is defined with reference to industry and governmental standards set forth in publications referred to. The seal is accomplished by the interaction of a resilient tapered sealing fin depending from the upper inner portion of the closure and a tapered sealing surface which forms the upper terminal surface of the container. The angle and configuration of the container sealing surface is disclosed as being within well-defined limits and the angle and configuration of the sealing fin is also well-defined.

The copending application also teaches that the closure and its projecting sealing fin may be molded as a single piece if desired.

The copending application also teaches that the container-closure combination may include a threaded connection between the parts, or a so-called "child-proof" combination comprising a well-known bayonet lock between the closure and container.

While a one-piece closure has certain advantages, I have found that the ease with which closures of my invention may be formed can be improved by molding the closure in two pieces. This not only permits the use of different materials for that portion of the closure carrying the sealing fin and the remainder of the closure but also simplifies the molding process itself. The first piece of the two-piece closure may comprise the element that attaches to the container either by screw threads or by the bayonet lock or by any other attachment means. The second element includes the panel that interfits into the top of the closure and the depending flexible sealing fin. Means are provided to assemble the two parts in a manner that requires only a friction fit as by interfitting ribs and grooves. Once the parts are snapped together, there is no likelihood that they will become accidentally separated.

It is particularly true that in closures for child-proof containers it is sometimes desirable to select a less resilient plastic material for the attachement portion of the cap than is required for the successful production of the flexible depending sealing fin. It is important that the sealing fin not only performs the sealing function but also serve as a spring to hold the bayonet lock in its closed position.

STATEMENT OF THE INVENTION

The invention comprises a child-proof container and closure combination comprising, a vial having an open end defined by an outwardly tapered surface having an angle of taper of 55° or less to the longitudinal axis of the container, a closure comprising a body having an upper panel spanning the vial opening and depending side walls for attachment to the vial, a peripheral series of retaining elements on the vial spaced axially from the tapered sealing surface thereof, said retaining elements having notches therein, a peripheral series of lugs on the interior side wall surfaces of the closure corresponding in spacing and number to said notches and cooperating therewith to form a closure which requires both an axial and rotational movement for release of the closure from the vial, a separate seal element retained within the closure and spanning at least the vial opening, said seal element having a resilient tapered sealing fin integral therewith and extending downwardly and outwardly at an angle from 10° to 20° less than the angle made by said vial sealing surface and being brought into sealing position by the seating of said lugs in said notches to form a seal that is "tight" or "well-closed" by industry standards and being held in said sealing position by the resiliency of said fin.

DETAILED DESCRIPTION OF A PREFERRED EMBODIMENT

Figure 1:
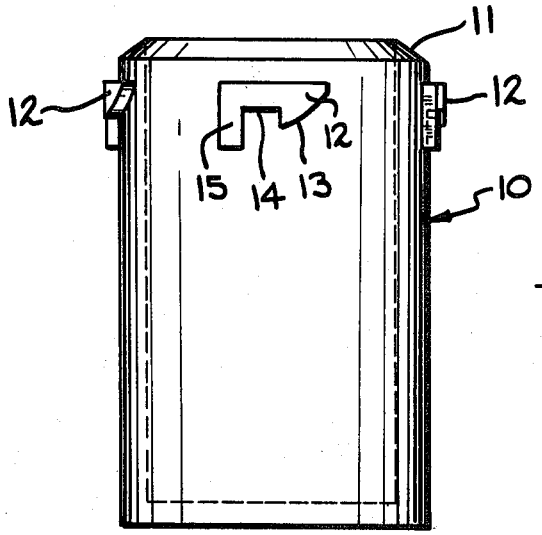
FIG. 1 is a side elevational view of a vial or container used with the present invention.

FIG. 1 of the drawings shows a vial designated generally 10 having a tapered sealing surface 11 at its open end. The angle made by the sealing surface with the longitudinal axis of the vial is 55° or less as set forth in my copending application identified above.

The vial is shown as being provided with a peripheral series of lock elements 12 each having a cam surface 13, a notch 14 and a stop portion 15. These lock elements are shown and described in Hedgewick U.S. Pat. No. 3,344,942. In the present invention, the bottom of the notch 14 is removed from the upper surface of the vial a much greater distance than is shown in the Hedgewick patent to increase the tapered sealing contact between parts as hereinafter described.

The closure of the instant invention is designated generally 20 and comprises a cap having depending side walls 21 and a top panel 22. A series of inwardly extending lugs 23 on the side walls is provided to cooperate with the lock elements 12 by seating in the notches 14 to complete the child-proof closure of the type generally described in the Hedgewick patent.

Figure 2:
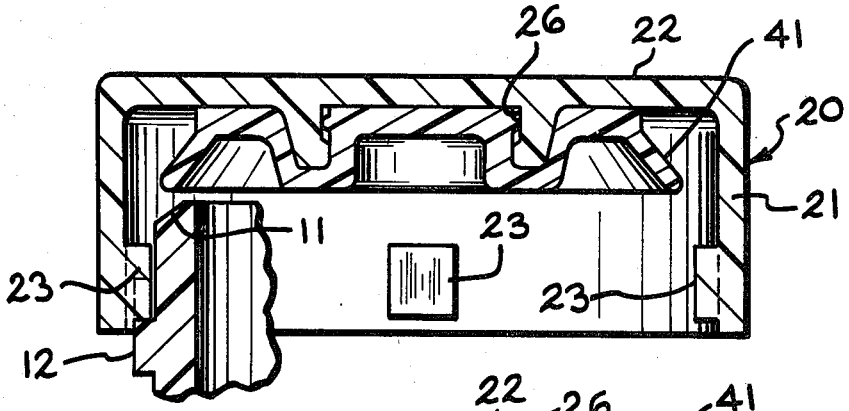
FIG. 2 is a central vertical sectional view of a closure constructed in accordance with the invention with the vial being indicated in dotted lines.
Figure 3:
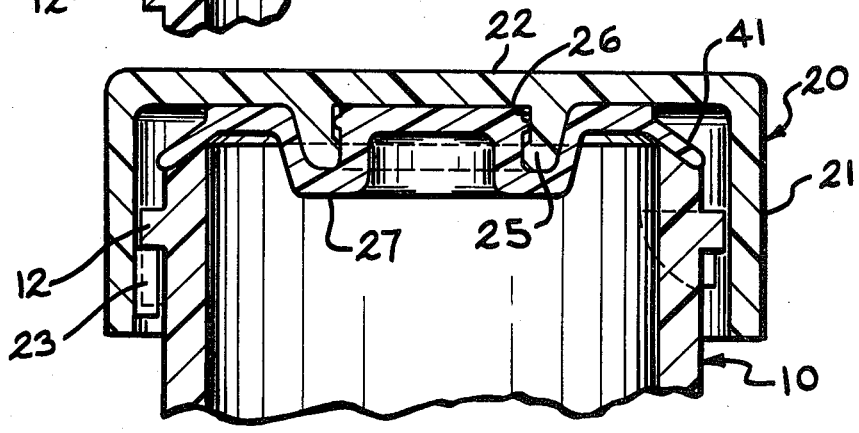
FIG. 3 is a central vertical sectional view of a child-proof container combining the vial of FIG. 1 and the closure of FIG. 2.

In the form of the invention shown in FIGS. 2 and 3, the top panel 22 is provided with an integrally molded centrally located annular ring 25. The ring 25 has, on its interior surface, a slight undercut 26. The exterior of the ring is tapered only enough to make it easy to remove the part from the molding die.

The annular ring 25 serves as a male attachment part for an inner panel element designated generally 27 having a major flat surface 28 that fits against the inner surface of the panel 22 and is functionally integral therewith. An annular recess 29 receives the ring 25 and a re-entrant central portion 30 is provided with a small radial rib 31 which is snapped into the undercut 26 to assemble the panel parts. At its periphery, the inner panel element 27 has a tapered sealing fin 32 which overlies and cooperates with the tapered sealing surface 11 of the vial. The lip extends downwardly and outwardly at an angle from 10° to 20° less than the angle made by the container sealing surface 11 with the longitudinal axis of the vial.

While FIG. 2 shows the parts in a pre-closing position, FIG. 3 shows the parts in closed position with a "tight" or "well-closed" seal being made between the sealing fin 32 and the container surface 11.

The National Formulary XIV and the United States Pharmacopoeia XIX have issued current standards for containers for drugs which require packaging and storing in a tight container or a well-closed container. The standard includes a Moisture Vapor Penetration test for the container itself and for the closure. The procedure to be employed in the test is described in detail in the National Formulary XIV, pages 888–889. Each container and its closure must be closed tightly and opened 30 times before the test is begun. Then each container is filled with desicated calcium chloride and sealed with an application torque as stated in the Table below:

| Container Diameter | Suggested application torque (in inch-pounds) |
|---|---|
| 28 mm. | 11–17 |
| 33 mm. | 13–20 |
| 38 mm. | 15–23 |
| 43 mm. | 17–26 |
| 48 mm. | 19–29 |
| 58 mm. | 23–35 |

After weighing each individual container, the containers are put in an atmosphere which is controlled as to temperature and humidity for a period of two weeks. They are then individually reweighed to determine the amount of moisture absorbed by the calcium chloride. This is related to the volume of the container to determine the weight of water absorbed stated in milligrams per liter of capacity per day. The weight of the absorbed water should not exceed 100 milligrams of water per liter of capacity per day if the seal is to be classified as "tight" by industry standards.

The moisture vapor penetration characteristic of a container is important because many drugs are subject to deterioration on prolonged exposure to mositure and many persons keep prescription drugs in the bathroom where the humidity is frequently high. The seal tightness suggested in the test is the standard generally accepted in the closure and container industries, based on their experience of the torques required to seat a closure on a container sufficiently tight to insure protection of the contents in packages using the normal commercial liners. These liners are mostly wood pulp with a facing of polyvinylidine chloride or Saran. These suggested application torques are much higher than the torques that most of the people using prescription drugs normally exert in securing a container cap.

The users of prescription drugs close the container many more times than does the pharmacist. The effectiveness of the seal when the user closes the container is the basic factor in determining whether the purity and efficacy of the drug will be maintained by the package. Many of the users of prescription drugs are infirm, arthritic or sick. Others think of a closure as merely a device to keep the contents from spilling in the event the container is upset. Random tests on the 28 mm. size closure show that about half of the people normally reclose containers with three inch-pounds of torque or less and that few persons will exert a torque greater than seven inch-pounds on this size closure.

The present invention results in a "tight" seal between the container and the child-proof closure that may be readily opened by the application of less than seven inch-pounds of torque. It is only necessary for the user to overcome the axial spring force of the sealing lip or fin 32 to apply or remove the cap, plus the small circumferential friction that exists between the fin 32 and its cooperating sealing surface 11.

Figure 4:
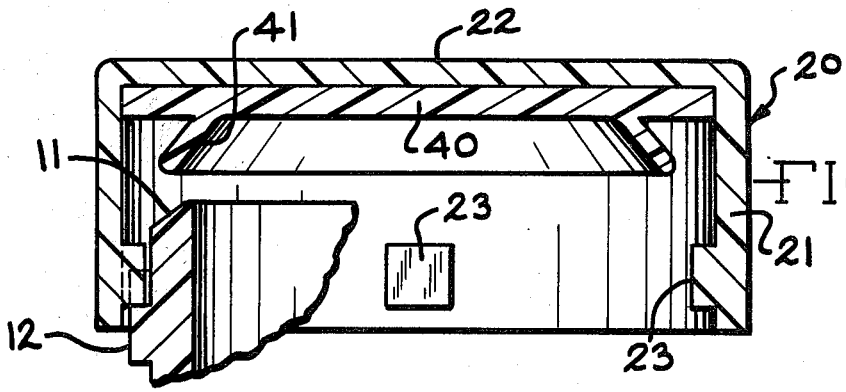
FIG. 4 is a central vertical sectional view of a modified form of closure.

A modified form of the invention is shown in FIG. 4 which comprises a flat panel 40 molded separately from the remainder of the cap and frictionally held therein against the under surface of the cap panel 22. The depending sealing lip 41 is of the same form and configuration as the sealing fin 32 previously described and described also in my copending application above noted. The attachment lugs 23 may again be molded as a part of the cap 20 by procedures which are known in the art.

What I claim is:

1. A child-proof container and closure combination comprising, a vial having an open end defined by an outwardly tapered surface having an angle of taper of 55° or less to the longitudinal axis of the container, a closure comprising a body having an upper panel spanning the vial opening and depending side walls for attachment to the vial, a peripheral series of retaining elements on the vial spaced axially from the tapered sealing surface thereof, said retaining elements having notches therein, a peripheral series of lugs on the interior side wall surfaces of the closure corresponding in spacing and number to said notches and cooperating therewith to form a closure which requires both an axial and rotational movement for release of the closure from the vial, a separate seal element retained within the closure and spanning at least the vial opening, said seal element having a resilient tapered sealing fin integral therewith and extending downwardly and outwardly at an angle from 10° to 20° less than the angle made by said vial sealing surface and being brought into sealing position by the seating of said lugs in said notches to form a seal that is "tight" or "well-closed" by industry standards and being held in said sealing position by the resiliency of said fin.

2. A child-proof container-closure combination in accordance with claim 1 in which an inwardly extending ring is formed on the under surface of said upper cap panel, and said seal element includes a re-entrant center securing portion cooperating with said ring to hold the parts in assembled relation.

* * * * *